United States Patent [19]

Jakob

[11] 4,045,012

[45] Aug. 30, 1977

[54] ADJUSTABLE FOLDING APPARATUS FOR ZIGZAG FOLDING

[75] Inventor: Hans Jakob, Darmstadt-Eberstadt, Germany

[73] Assignee: Maschinenfabrik Goebel GmbH, Darmstadt, Germany

[21] Appl. No.: 690,670

[22] Filed: May 27, 1976

[30] Foreign Application Priority Data

May 27, 1975 Germany ..... 2523424

[51] Int. Cl.[2] ..... B65H 45/20

[52] U.S. Cl. ..... 270/79

[58] Field of Search ..... 270/79, 61 F, 30–31

[56] References Cited

U.S. PATENT DOCUMENTS 2,289,615 7/1942 Williams ..... 270/79

*Primary Examiner*—Edgar S. Burr
*Assistant Examiner*—A. Heinz
*Attorney, Agent, or Firm*—Watson, Cole, Grindle & Watson

[57] ABSTRACT

A folding apparatus for the zigzag folding of a web includes at least one reciprocating channel guide through which the web passes, the channel being engageable with the apparatus at a selected and changeable pivot point to thereby effect an adjustment of the amplitude of the channel for the folding of differently sized web sections. A pair of pivotally connected channels is alternatively provided, the upper and lower ones of which also being engageable with the apparatus at a selected and changeable pivot point.

7 Claims, 4 Drawing Figures

ADJUSTABLE FOLDING APPARATUS FOR ZIGZAG FOLDING

BACKGROUND OF THE INVENTION

This invention relates generally to an apparatus used for the zigzag folding of a web, and more particularly to such an apparatus having at least one channel guide for the folding operation which is engageable with the apparatus at a selected and changeable pivot point for adjusting the oscillation amplitude thereof.

A typical folding apparatus for the zigzag folding of webs of paper or other materials is operatively connected to a printer so that the forms printed from webs of indeterminate length may be conveniently fan-folded or zigzag folded along lines of weakening disposed transversely to the direction of feed of the web through the printer. The spacing of these lines of perforations corresponds to the particular size of the series-connected sheets or formats of the web to be printed. The folding apparatus must therefore be adjusted to accommodate differently sized series-connected sheets from one folding operation to the next.

U.S. Pat. No. 3,889,940, commonly owned herewith, represents an improvement over German Pat. No. 1,070,010, dated May 12, 1960, also commonly owned herewith. In this U.S. Pat., a web guide or channel is provided through which the web to be folded passes, and the guide is connected at opposite ends with the oscillation means. This oscillation may be positively adjusted to accommodate varying form sizes so as to assure that the web is folded along its transverse lines of weakening during each folding operation. However, in both the aforementioned U.S. and German patents, the channel guides are mounted for movement on the machine about stationary pivots, and the cam members to which the channel guides are connected are adjustable toward and away from the channel guides so as to adjust the amplitude of the reciprocating channel guides. In U.S. Pat. No. 3,889,940, the entire disclosure of which is specifically incorporated herein by reference, pivot pins 10 and 11 for the connected channel guides are fixedly secured to the machine frame and the respective pins at opposite sides of the guide are co-axial so that the channel guide is pivoted about these pins.

However, with the currently available high speed printers, the web channel guide must be oscillated at high frequencies in accordance with web velocity, and the oscillation frequencies are even further increased to accommodate the folding of small-sized sheets as when the transverse lines of weakening are spaced closely together. Therefore, at high running printer speeds, especially during the folding of series-connected sheets having small spaced transverse lines of weakening, the oscillation forces to which the channel guides are subjected are intensified to such an extent as to affect the smooth folding operation of the machine. The presently available zigzag folding apparatuses are limited in their capacity for oscillating at certain high frequencies required for a particular folding operation.

SUMMARY OF THE INVENTION

It is therefore an object of this invention to provide an apparatus for the zigzag folding of a continuous web in which the channel guide of the apparatus is relieved of the otherwise present high stresses during oscillation even at high running printing speeds and during the folding of differently sized series-connected sheets.

Another object is to provide such a folding apparatus wherein the channel guide may be detachably coupled with the machine frame for pivotal movement about one of at least two pivot points respectively spaced from the pivotal connection between the channel guide and the rotating cam.

In carrying out these objectives, rod members are mounted on the machine frame for axial shifting movement into and out of engagement with co-axial bearing openings provided on the channel guide for establishing pivot points for the channel guide at a selected one of the co-axial openings so that the oscillation amplitude of the channel guide may be adjusted depending on the particular engagement between the rod members and one of the coaxial openings. The rod members are mounted for simultaneous engagement with the bearing openings of the channel guide as well as for alternating engagement with such openings to thereby effect a smooth transition of establishing the pivot points. And, the guide members have rack teeth thereon engageable with the teeth of a rotatable pinion gear disposed between a pair of such rod members so that upon rotation of the gear, one of the rod members is moved inwardly toward the channel guide while the other of the rod members is moved outwardly away therefrom. In accordance with another embodiment of the folding apparatus according to the invention, a pair of pivotally interconnected channel guides may likewise be disposed for guiding the web passing therethrough, one of the bearing openings being superimposed over such pivotal connection between the two channel guides with such bearing opening being engageable with one of the shifting rod members for changing the oscillation amplitude of the connected channel guides.

Other objects, advantages and novel features of the invention will become more apparent from the following detailed description of the invention when taken in conjunction with the accompanying drawings.

DETAILED DESCRIPTION OF THE INVENTION

Figure 1:
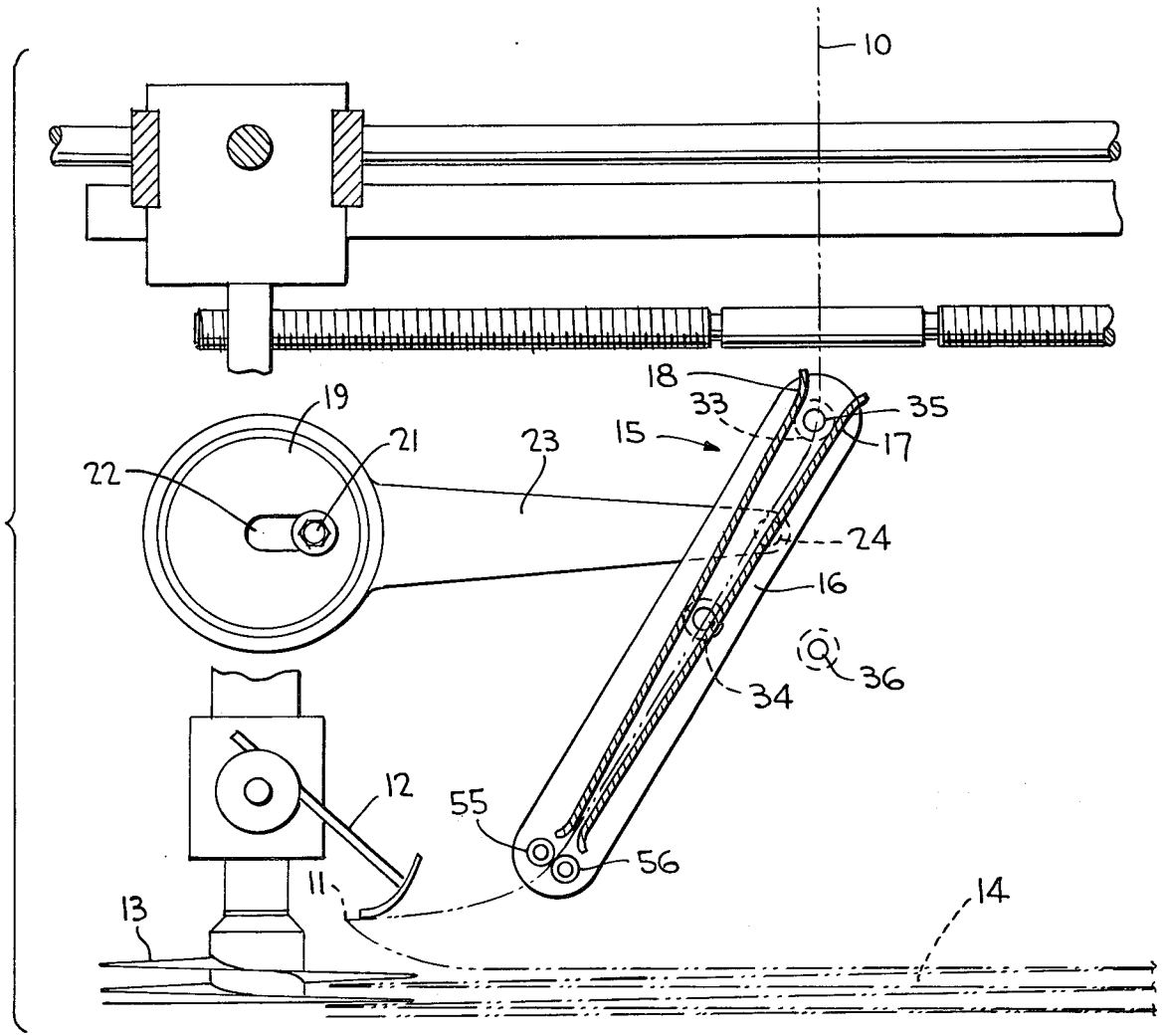
FIG. 1 is a side elevational view partly in section, of the folding apparatus according to the invention taken substantially along line 1—1 of FIG. 2.

Turning now to the drawings wherein like reference characters refer to like and corresponding parts throughout the several views, a continuous web 10 of paper or other material to be folded is shown in phantom outline in FIG. 1 and may comprise one or more superimposed layers of sheets which are series connected along spaced lines of weakening disposed transversely to the direction of feed through the printer and through the folding apparatus. The web is moved downwardly from the web conveying device into the folding apparatus for folding in a manner generally similar to that described in the aforementioned German and U.S. patents. After the web moves through the channel guide device to be hereinafter more fully described, it is successively bent along one of its transverse lines 11 of weakening by means of beaters 12 cooperating with rotating guide elements 13 at opposite sides of the zigzag pack to thereby form a zigzag shaped stack 14 in a manner similar to that described in detail in the aforementioned German patent, as well as in British Pat. No. 894,791 corresponding thereto.

Figure 2:
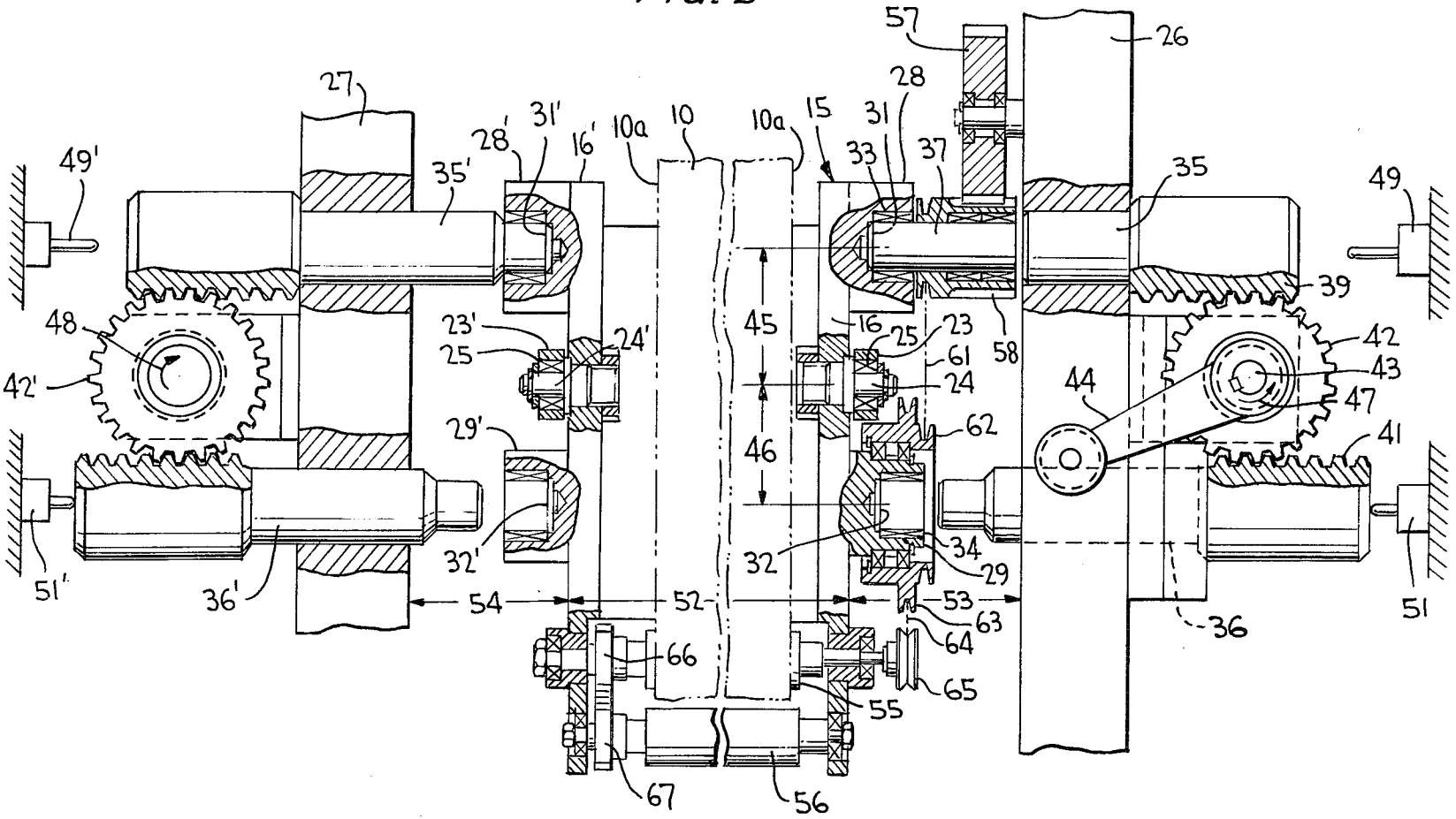
FIG. 2 is an end elevational view of the folding apparatus of FIG. 1 shown partly in section to illustrate several of the various details thereof.

In carrying out this folding operation, a channel guide device generally designated 15 is provided through which the web passes, such device comprising a pair of spaced end plates 16, 16' connected by a pair of spaced walls 17 and 18 mounted thereon and together forming a channel through which the moving web is guided. Oscillating movement of the channel guide device is effected similarly as in the aforementioned patents as by means of a cam 19 connected to a drive shaft by means of a fastener element 21 extending through an elongated opening 22 located in cam 19. The drive shaft is disposed axially behind fastener 21 similarly as shown in FIG. 2 of U.S. Pat. No. 3,889,940. Spaced arms 23 and 23' are mounted on the cam in any normal manner and are connected at the respective free ends thereof to end plates 16 and 16' of the channel guide device by means of pins 24, 24' and bearings 25, 25'. The eccentricity of cam 19 can be adjusted simply by loosening fastener 21 and moving the cam along elongated opening 22 and thereafter retightening the fastener.

As compared to the folding apparatus disclosed in the aforementioned patents wherein a stationary pivot point is provided for the upper channel guide or hopper about which the hopper is tilted as the cam rotates, channel guide device 15 herein is detachably coupled at its end plates 16, 16' with respective frame elements 26 and 27 of the machine frame. To effect such a coupling arrangement, end plate 16 (only one side of the machine will be described in detail since the other side thereof is the same) is provided with bearing blocks 28 and 29 thereon respectively having bottom-covered circular bearing openings 31 and 32 therein and anti-friction bearing members 33 and 34 in these openings. Similar bearing blocks having bearing openings and anti-friction bearings are provided on the opposing end plate 16' respectively in axial alignment with openings 31 and 32.

Elongated rod members 35 and 36 are mounted on frame member 26 for axial shifting movement toward end plate 16, and similar rod members 35' and 36' are mounted on frame member 27 for axial shifting movement toward and away from end plate 16'. Rod members 35 and 36 are respectively co-axial with bearing openings 31 and 32 and have circular nose portions 37 and 38 respectively engageable with these openings. Rack gear teeth 39 and 41 are provided on the rod members for engagement with the teeth of a pinion gear 42 mounted for rotation on its shaft 43 which is mounted on a portion of the machine frame. The pinion gear is manually rotatable by means of a lever 44 extending outwardly thereof. Rod members 35' and 36' have similar nose portions and rack gear teeth which are engaged with the teeth of a pinion gear 42', similarly as that described above with reference to rod members 35 and 36. However, pinion gear 42' is not provided with a lever such as 44 since both pinion gears are operatively interconnected as in any normal manner so that movement of lever 44 effects simultaneous rotation in opposite directions of the two pinion gears.

The longitudinal axis of rod member 35 is spaced a distance 45 from the center of pin 24 which is provided for pivotally connecting arm 23 with end plate 16. Also, the longitudinal axis of rod member 36 is spaced a distance 46 from the center of pin 24 on the opposite side thereof. Bearing openings 31 and 32 are therefore respectively spaced distances 45 and 46 on opposite sides of pin 24 so that when the nose portions of co-axial rods 35 and 35' are seated within their bearing openings 31 and 31', device 15 may be oscillated at a given amplitude different from the amplitude at which the device is oscillated when the nose portions of co-axial rods 36 and 36' are seated within their bearing openings 32 and 32'. The amplitude of the oscillating channel device is therefore adjustable depending on which of the co-axial pairs of rods are seated, and depending on the extent of distances 45 and 46.

Upon rotation of the pinion gears in the direction of their arrows 47 and 48 shown in FIG. 2, co-axial rod members 35 and 35' are together moved toward their respective end plates 16 and 16' until the nose portions thereof are fully seated within respective openings 31 and 31' located in bearing blocks 28 and 28'. Simultaneously with this shifting operation of bolts 35 and 35', bolts 36 and 36' are shifted outwardly away from their respective end plates so as to be fully out of engagement with their respective openings 32 and 32' of bearing blocks 29 and 29'. Accordingly, channel guide device 15 is pivotally connected to the frame of the machine by means of co-axial rod members 35 and 35'. On the other hand, rotation of the pinions in a direction opposite their arrows causes rod members 35 and 35' to disengage from their respective bearing blocks while co-axial rod members 36 and 36' are moved into engagement with openings 32 and 32' of their respective bearing blocks so as to establish a different pivotal connection between the channel guide device and the machine frame.

The position of rod members 35 and 35' are respectively determined by electric depression switches 49 and 49' fixedly mounted to the machine frame and lying co-axial therewith. Likewise, the position of rod members 36 and 36' are determined by electric depression switches 51 and 51' mounted on the machine frame and lying co-axial with their respective rod members. By suitable electrical connections, the switches may be designed for shutting off the folding operation when both pairs of switches are out of contact with the rod members. Therefore, with at least one of the switches 49, 49' or 51, 51' in contact with co-axial rod members, it can be assured that device 15 can be oscillated about one or the other of the co-axial rod members. Otherwise, if neither pair of co-axial switches is contacted by the rod members, power to the folding apparatus will be shut off since the rod members are so disposed relative to their respective bearing blocks that the nose portions of all the rod members will be made to partially engage the openings in their bearing blocks in the process of shifting from a rod-to-bearing block engagement as shown in FIG. 2 to that wherein rod members 36 and 36' are in engagement with the openings of their bearing blocks. Accordingly, the dimensions of the rod members, the width 52 of channel guide device 15 and the spacings 53 and 54 of the respective frame members 26 and 27 from opposite sides of device 15, are selected such that during a shifting of the rod members, both rod members can be coupled with device 15 simultaneously. Such an arrangement assures that device 15 is coupled to the machine frame during the coupling changeover from one pair of co-axial rod members to the other.

The run of web 10 emerging from the guide surfaces formed by walls 17 and 18 of the channel guide device, passes through the device between rollers 55 and 56. The drive means for these rollers is shown in FIG. 2 and includes a gear wheel 57 in meshing engagement with another gear wheel 58, both mounted on machine frame 26. Gear 58 includes a belt pulley 59 which drives an endless belt 61, shown in phantom outline, which in turn drives a belt pulley 62 concentric with and mounted for rotation about bearing block 29. Another belt pulley 63 coupled with pulley 62 drives another endless belt 64, shown in phantom outline, which extends over a belt pulley 65 securely fixed to feed roll 55 for driving same. Feed roll 56 is driven by means of intermeshing gear wheels 66 and 67 located on the respective feed rolls.

Figure 4:
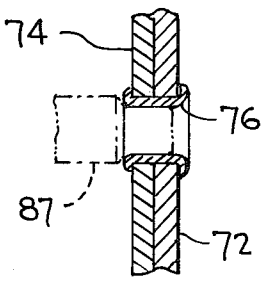
FIG. 4 is a detail sectional view of the pivotal connection between the upper and lower channel guides, taken substantially along line 4—4 of FIG. 3.
Figure 3:
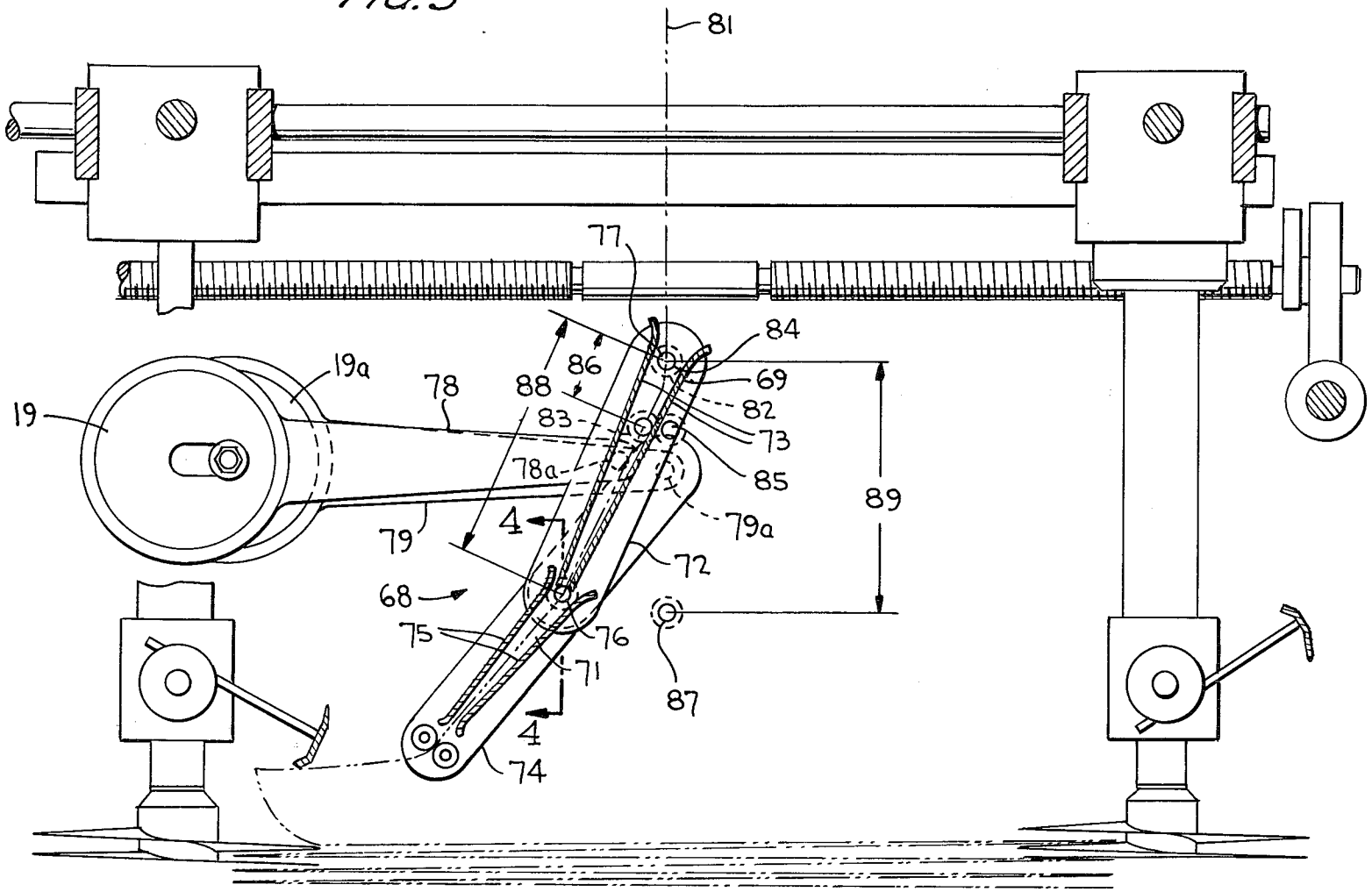
FIG. 3 is a view similar to FIG. 1 of another embodiment of the zigzag folding apparatus according to the invention.

The folding apparatus according to the FIG. 3 embodiment is similar to that shown in U.S. Pat. No. 3,889,940 to the extent that channel guide device generally designated 68 herein comprises an upper funnel 69 and a lower funnel 71. The upper funnel comprises a pair of spaced end plates 72 interconnected by spaced walls 73, and lower funnel comprises a pair of spaced end plates 74 interconnected by a pair of spaced walls 75. The lower funnel is connected to the upper funnel at a pivot joint 76 which, as shown in FIG. 4, may comprise a hollow rivet which permits relative pivotal movement between end plates 72 and 74, although equivalent means may be used as a pivot joint where desired. This rivet has an opening sufficiently large to accommodate the nose portion of a rod member in a manner to be more fully described hereinafter. The upper funnel may be pivotally coupled to the machine frame at a pivot joint 77 which represents a bearing block having an opening therein for the reception of a rod member similarly as described in the FIG. 2 embodiment. Of course, pivot joints 76 and 77 are likewise provided at the opposite side of device 68 so that co-axial rod members may be alternatively coupled therewith in the same manner as described for the FIG. 2 embodiment.

Arms 78 and 79 are mounted about their respective cams 19 and 19*a* at one end and are pivotally connected at 78*a,* 79*a* to the end plates of their respective funnels. Continuous web 81 extending between the spaced walls of the funnels may therefore be folded similarly as described in U.S. Pat. No. 3,889,940.

A pair of bearing blocks 82 and 83 are mounted on end plates 72, pairs of each of these opposite blocks being co-axial and having openings therein similarly as described with reference to FIG. 2. Pairs of axially shiftable rod members 84 and 85 mounted on the machine frame and spaced a distance 86 from one another are arranged and function in an identical manner for alternating movement into and out of engagement with the openings in bearing blocks 82 and 83, similarly as shown in FIG. 2. For example, rod members 84 and 85 are coupled to one another through pinion gears and are designed to actuate on-and-off switches similarly as described in FIG. 2. Another axially movable rod member 87 is mounted on the machine frame substantially in vertical alignment with rod members 84 and 85. Therefore, upon adjustment of the upper funnel to the position wherein joint 76 lies co-axial with rod member 87, the upper and lower funnels may be coupled to the machine frame as rod member 87 is shifted into engagement with hollow rivet 76, as illustrated in FIG. 4. Spacing 88 between joints 77 and 76 must therefore be equal to spacing 89 between joint 77 and rod member 87. It should be noted that, for reasons of clarity, reference above made to a rod member indicates co-axial rod members which function to engage opposing sides of device 68 similarly as in FIG. 2.

Accordingly, when large series-connected sheets or formats are to be zigzag folded, rod members 85 are moved into engagement with the co-axial bearing blocks 82 on end plates 72 of the upper funnel, while rod members 85 and 87 remain uncoupled with the channel guide device. The channel guide device may then be pivoted about joint 77, and the lower funnel can be pivoted relative to the upper funnel at joint 76.

If small sheets or formats are to be folded, rod members 87 may be shifted into engagement with co-axial hollow rivets 76, while rod members 84 and 85 remain uncoupled with their respective bearing blocks. Oscillation of the upper funnel may then be suspended while oscillating only the lower funnel. Also, with such an arrangement, the upper funnel is capable of being oscillated to a slight degree while oscillating the lower funnel to an increased extent.

From the foregoing, it can be seen that by alternating the pivot points for the channel guide devices, the stresses normally building up in the folding apparatus are maintained at a minimum even during high running speeds of the printer and while processing differently sized sheets and formats. The most favorable pivot joint may be selected for the channel guide device for the particular fan-folded operation required. In such manner, the forces due to inertia of the oscillating channel guide device are kept small, and high stresses in the channel guide device are avoided even at high frequencies. Moreover, the operational speed of the folding apparatus may be increased compared with the prior art folding apparatuses. And, since the folding apparatus typically limits the running speed of a printer to which the apparatus is connected, the printer may also be run at a higher speed when coupled with a folding apparatus of the type described herein. Production efficiency is therefore increased. Also, the time required to change over from one pivot point to another for the channel guide devices is short so that downtime of the machine does not present a problem.

Obviously, many modifications and variations of the present invention are made possible in the light of the above teachings. For example, the bearing blocks on the end plates of device 15 may be disposed in different locations than shown on the end plates for coupling with co-axial rod members similarly relocated, or bearing blocks in addition to those shown may be provided on channel guide device 15 for coupling the device at any number of different locations with the machine frame with the use of shiftable rod members as in the manner described in FIG. 2. And, different locations and different numbers of bearing blocks and corresponding shiftable rod members may be provided for channel guide device 68. Also, the upper opening 91 between the spaced walls of the upper funnel should be maintained sufficiently large in order to insure a disturbance free run of web 81 to be folded through the folding apparatus.

It is therefore to be understood that within the scope of the appended claims the invention may be practiced otherwise than as specifically described.

What is claimed is:

1. In a folding apparatus having a frame member and including at least one oscillating channel guide device for delivering a web of paper or other material downwardly from a web conveyor in zigzag folds, said device having opposite sides, means for effecting a synchronous movement of said channel guide device including at least one rotatable cam having elongated arms connected to said opposite sides of said channel guide device at first pivot points for reciprocating same upon rotation of said cam, said cam being mounted on a drive shaft by fastening means extending through an elongated opening extending substantially along the longitudinal axis of said arms, said device having at least a first and second pair of bearing openings therein which are respectively co-axial and which extend parallel to said drive shaft, said openings being spaced from said first pivot points, and a first pair of co-axial rod members and a second pair of co-axial rod members, each pair respectively mounted on said frame member for axial shifting movement into and out of engagement with said first and second pair of co-axial openings for establishing second pivot points in said channel guide device, means for moving each respective pair of rod members into engagement with said first and second pair of co-axial openings thereby establishing alternate second pivot points in said device, whereby the amplitude of said channel guide device may be adjusted depending on the particular engagement between said co-axial rod members and one of said co-axial openings.

2. The folding apparatus of claim 1, wherein said first pivot points lie between said pairs of openings of said device.

3. The folding apparatus of claim 1, wherein said rod members are likewise mounted for simultaneous engagement with said openings whereby to effect a smooth transition of establishing said second pivot points.

4. The folding apparatus of claim 3, wherein said rod members have rack teeth thereon, toothed pinion gears mounted on said frame member respectively in toothed engagement with one of both pairs of said rod members and being operatively interconnected for rotation together in opposite directions, whereby rotation of said pinion gears in opposite directions effects shifting movements of said rod members into alternating engagement and disengagement with said openings.

5. The folding apparatus of claim 1, wherein another said device is provided and is pivotally connected to said one device, a pair of said cams being provided and integrally connected together, and said devices being independently connected to a respective one of said cams.

6. The folding apparatus of claim 5, wherein one of said bearing openings overlies the pivotal connection between said devices.

7. The folding apparatus according to claim 6, wherein a pair of said bearing openings is provided in said one device disposed upwardly of said another device relative to the direction of web movement.

* * * * *